US005540382A

United States Patent [19]

Scheller

[11] Patent Number: 5,540,382

[45] Date of Patent: Jul. 30, 1996

[54] MUD DISPERSEMENT DEVICE FOR MOUNTING UNDERNEATH RAILWAY TIES

[76] Inventor: James D. Scheller, 2414 Applewood La., Salina, Kans. 67401

[21] Appl. No.: 501,783

[22] Filed: Jul. 13, 1995

[51] Int. Cl.[6] ..... E01B 1/00; E01B 3/00

[52] U.S. Cl. ..... 238/2; 238/30

[58] Field of Search ..... 238/1, 2, 29, 30, 238/59, 60, 61, 75, 82

[56] References Cited

U.S. PATENT DOCUMENTS

| | | | |
|---|---|---|---|
| 507,179 | 10/1893 | Steiner | 238/17 |
| 1,015,172 | 1/1912 | Gorsuch | 238/38 |
| 1,020,886 | 3/1912 | Collins | 238/79 |
| 1,032,045 | 7/1912 | Collins | 238/79 |
| 1,122,132 | 12/1914 | Lasher | 238/37 |
| 1,240,658 | 9/1917 | Bond | 238/75 |
| 1,244,616 | 10/1917 | Kruse | 238/106 |
| 1,360,594 | 11/1920 | Snyder | 238/62 |

FOREIGN PATENT DOCUMENTS

| | | | |
|---|---|---|---|
| 589228 | 12/1933 | Germany | 238/106 |
| 44906 | 4/1977 | Japan | 238/2 |
| 292006 | 10/1953 | Switzerland | 238/106 |
| 1194938 | 5/1985 | U.S.S.R. | 238/30 |

*Primary Examiner*—S. Joseph Morano
*Attorney, Agent, or Firm*—John R. Flanagan

[57] ABSTRACT

A pair of mud dispersement devices are deployed beneath a railroad tie and upon ballast material supporting the tie. Each device includes a flat elongated structure for underlying a half of the railroad tie and resting upon the ballast material supporting the tie. The elongated structure has opposite inner and outer ends and opposite top and bottom surfaces and defines a wedge-shaped cavity below the bottom surface which increases in height proceeding from the inner end of the elongated structure to the outer end thereof. A plurality of support elements are mounted on the top surface of the elongated structure and project upwardly therefrom for contacting the railroad tie to transmit a load produced by rolling stock moving on the railroad track downwardly from the railroad tie to the inclined plate. A plurality of ballast collection and mud dispersion elements are mounted on a bottom surface of the inclined plate and project downwardly therefrom into the ballast material for maintaining the ballast material in the load bearing area beneath the railroad tie while permitting the passage of mud from the load bearing area toward and beyond the outer end of the side members in response to the downward load transmitted from the railroad tie to the inclined plate.

22 Claims, 2 Drawing Sheets

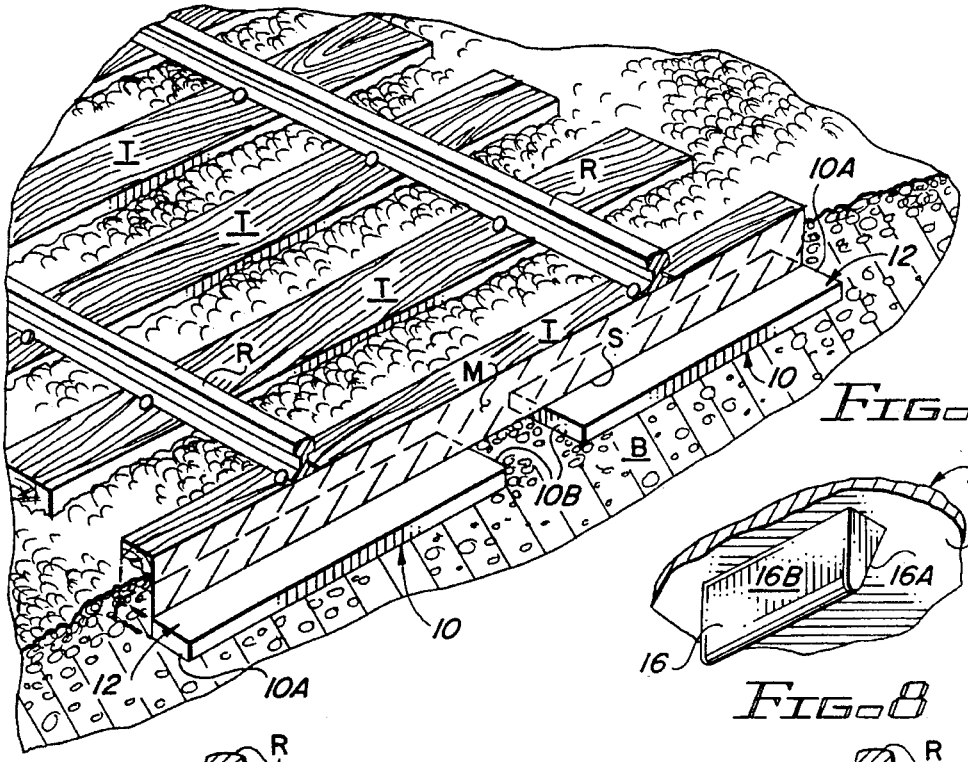
FIG. 1
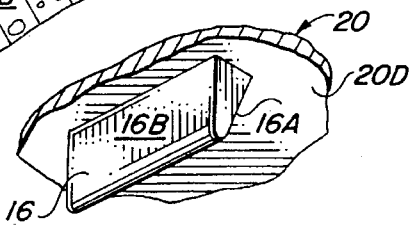
FIG. 8
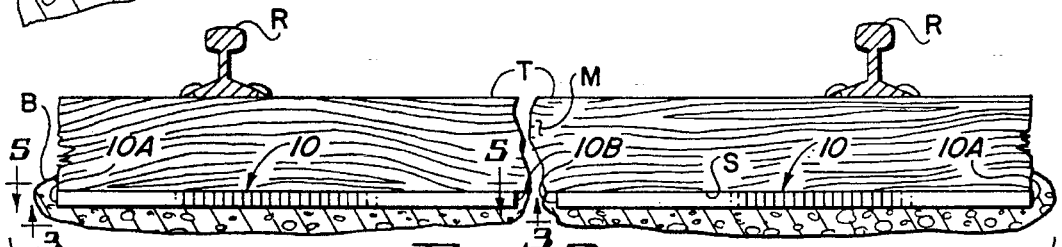
FIG. 2
FIG. 3
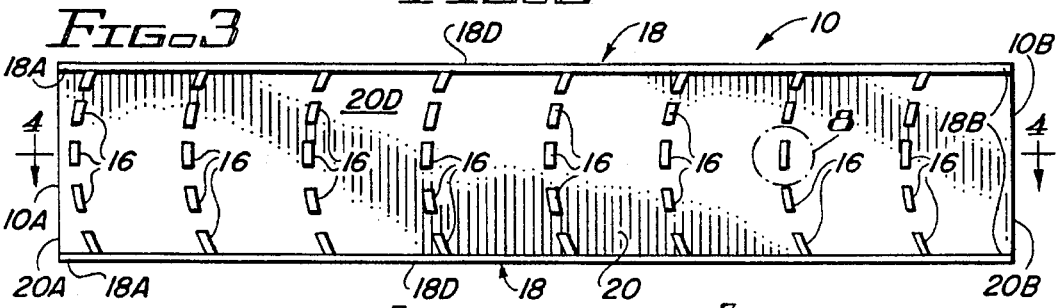
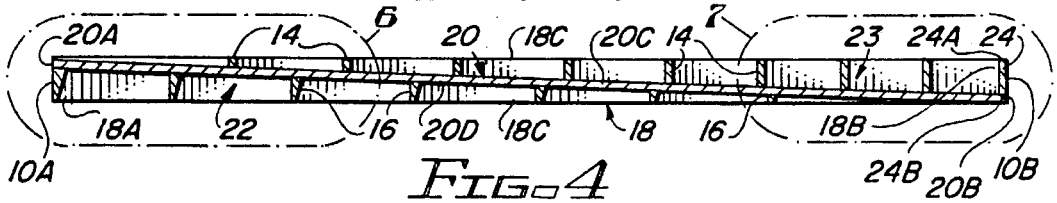
FIG. 4

FIG. 5
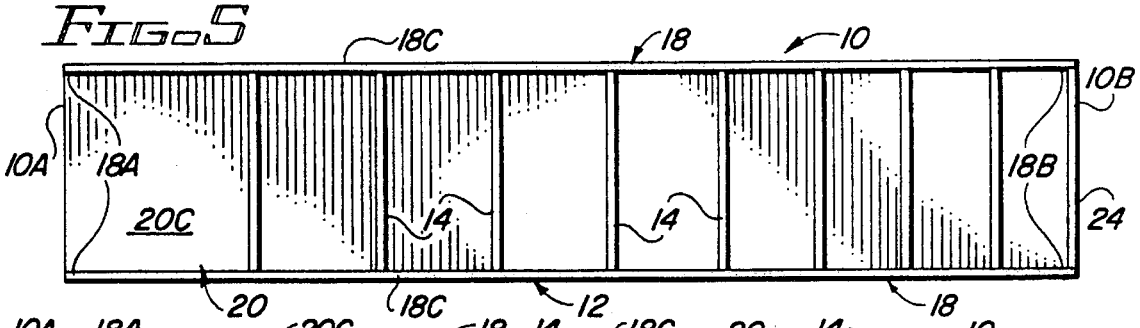
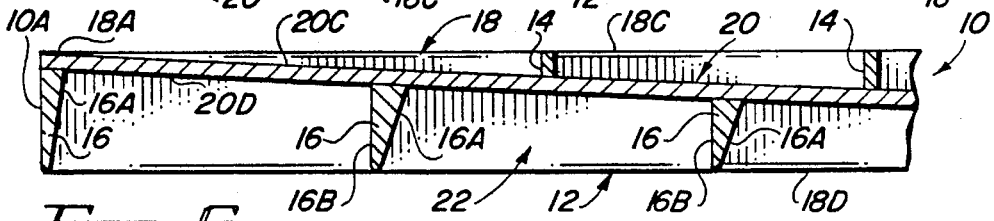
FIG. 6
FIG. 7
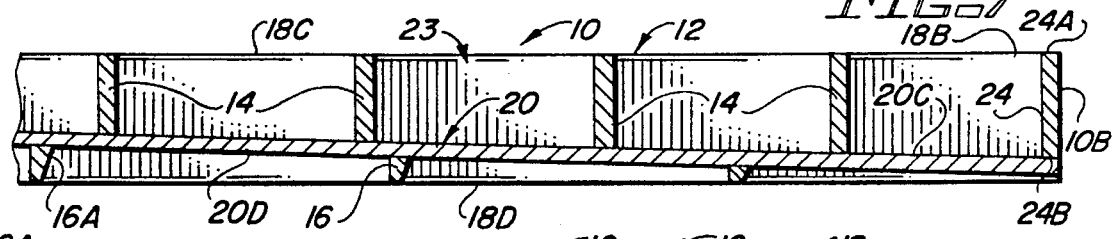
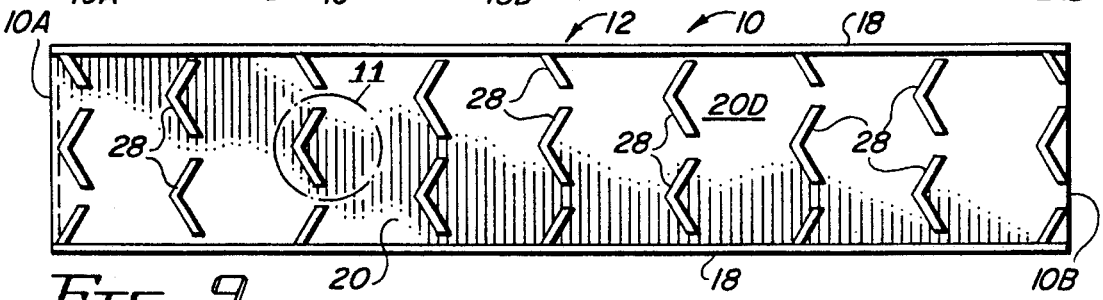
FIG. 9
FIG. 10
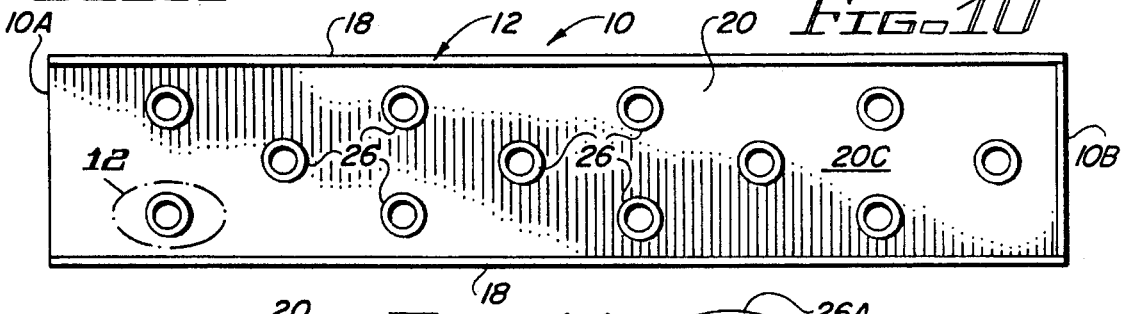
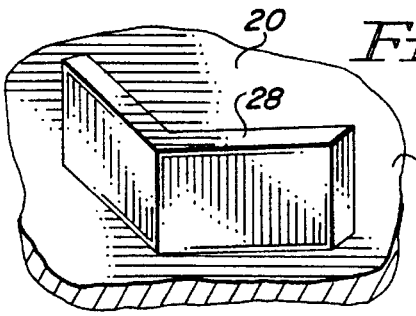
FIG. 11
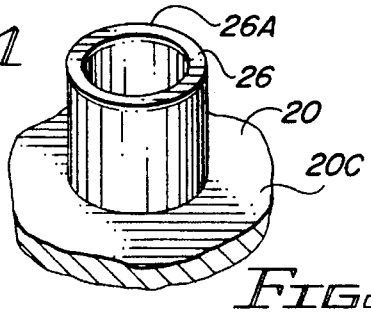
FIG. 12

MUD DISPERSEMENT DEVICE FOR MOUNTING UNDERNEATH RAILWAY TIES

BACKGROUND OF THE INVENTION

1. Field of the Invention

The present invention generally relates to railroad ties and, more particularly, is concerned with a mud dispersement device for use below a lower surface of a railroad tie and upon a quantity of ballast material applied on the roadbed supporting the railroad tie.

2. Description of the Prior Art

The rails of a railroad track are supported upon a plurality of ties which in turn are supported upon a quantity of ballast material applied on the roadbed of the track. The ballast material serves several important purposes including holding the track to its desired position, distributing weight, dissipating force and providing drainage.

A significant problem with respect to railroad track stability can develop if poor drainage occurs and persists in the ballast material. When poor drainage occurs, mud will accumulate along and underneath the railroad ties. Then, as load pressure from rolling stock is alternately applied and released on the track, a vacuum condition is created under the ties which acts like a pump, drawing sub-soil moisture through the ballast to under the ties where it will remain because of the prevailing poor drainage condition.

The primary cause of poor drainage is ballast that has become fouled by dirt introduced into the ballast material through internal abrasion of the ballast material and external intrusion of wind blown dirt, sand, grain, coal and other commodities leaked from rail cars. Mud results when rainfall occurs or there is sub-grade intrusion of moisture into fouled ballast. The problem is particularly acute when mud accumulates in the critical load bearing area directly beneath a railroad tie. While it is relatively easy to periodically remove mud from the ballast shoulder at the ends of railroad ties with a ballast regulator, spread plow or similar equipment, heretofore, there has been no way to remove mud from the critical areas of the ballast immediately beneath individual railroad ties without resorting to costly procedures.

Consequently, a need still exists for a means for moving mud accumulated in the critical load bearing area directly beneath a tie laterally to the ballast shoulder at the ends of the tie where it can be removed with a ballast regulator.

SUMMARY OF THE INVENTION

The present invention provides a mud dispersement device designed to satisfy the aforementioned need. The mud dispersement device of the present invention is intended to be disposed immediately beneath a railroad tie and upon ballast material which supports the tie. The mud dispersement device comprises: (a) a generally flat elongated structure for underlying at least a portion of a railroad tie and resting upon ballast material supporting the tie, the elongated structure having opposite inner and outer ends and opposite top and bottom surfaces, the elongated structure defining a wedge-shaped cavity below the bottom surface which increases in height proceeding from the inner end of the elongated structure to the outer end thereof; (b) upper means mounted on the top surface of the elongated structure for contacting the railroad tie to transmit a load produced by rolling stock moving on the railroad track downwardly from the railroad tie to the elongated structure; and (c) lower means mounted on the bottom surface of the elongated structure and extending downwardly through the wedge-shaped cavity and into the ballast material supporting the elongated structure, the lower means for maintaining the ballast material in a load bearing area beneath the railroad tie while permitting the passage of mud from the load bearing area through the wedge-shaped cavity toward and beyond the outer end of the elongated structure as a result of the mud being squeezed by alternating vertical contraction and expansion of the wedge-shaped cavity toward and away from the ballast material in response to alternating application and release of the downward load by the railroad tie to and from the elongated structure.

More particularly, the upper means is a plurality of support elements mounted on the top surface of the elongated structure and extending upwardly therefrom for contacting the railroad tie. The support elements are spaced apart from one another along a longitudinal dimension of the elongated structure extending between the outer and inner ends thereof. The lower means is a plurality of ballast collection and mud dispersion elements mounted on the bottom surface of the elongated structure and extending downwardly therefrom into the ballast material. The ballast collection and mud dispersion elements are spaced apart from one another along the longitudinal dimension of the elongated structure. The ballast collection and mud dispersion elements are arranged in a plurality of groups extending generally transverse to the longitudinal dimension. The ballast collection and mud dispersion elements in each group are spaced apart from one another generally transversely to the longitudinal dimension of the elongated structure. Also, the ballast collection and mud dispersion elements in each group are progressively greater in height proceeding along the longitudinal dimension from the inner end of the elongated structure to the outer end thereof.

Further, the flat elongated structure of the mud dispersement device includes a pair of elongated side members each having opposite inner and outer ends and opposite top and bottom longitudinal edges, and an elongated inclined plate having opposite top and bottom surfaces and opposite upper and lower ends. The inclined plate is disposed between and along the side members and rigidly connected thereto. Also, the inclined plate extends diagonally between the outer and inner ends of each of the side members from the lower end of the inclined plate being located adjacent to the bottom longitudinal edges of the side members at the inner ends thereof to the upper end of the inclined plate being located adjacent to the top longitudinal edges of the side members at the outer ends thereof so as to define the wedge-shaped cavity below the bottom surface of the inclined plate which increases in height proceeding from the inner ends of the side members to the outer ends thereof.

Preferably, the mud dispersement device is of a predetermined size relative to a railroad tie such that a pair of the mud dispersement devices may be disposed beneath a given railroad tie with each plate being beneath one of a pair of opposite halves of the tie and oriented so that outer ends of the side members of each device are disposed adjacent to respective opposite ends of the tie and inner ends of the side members of each device are spaced apart from one another near but in opposite directions from a middle portion of the railroad tie and so that the wedge-shaped cavities of the devices increase in height proceeding in opposite directions from the middle portion of the railroad tie.

One feature of the mud dispersion device of the present invention is that when a load is applied to the top of the railroad tie such as by rolling stock moving on the railroad track, it is transmitted downward from the railroad tie to the inclined plate by the support elements mounted on the top surface of the inclined plate which contact the lower surface of the railroad tie. The inclination of the inclined plate in response to the load imposed thereon forces moisture and mud below each of the mud dispersion devices to move outward from below the center of the railroad tie to below the ends of the tie thereby cleansing dirt and mud from the critical load bearing area directly beneath the tie and depositing it at the outer ends of the tie where the shoulder ballast can easily be cleaned periodically with a ballast regulator.

Another feature of the mud dispersion device of the present invention is that the collection and dispersion elements mounted on the bottom surface of the inclined plate and extending downwardly into the ballast material maintain and consolidate the ballast material in the critical load bearing area directly beneath the railroad tie as these elements concurrently permit the passage of the dirt and mud to the respective opposite ends of the railroad tie. These elements keep the ballast material from being forced to the ends of the tie with the mud when a load is applied to the top of the tie.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view showing a railroad track and a pair of mud dispersement devices of the present invention disposed beneath a railroad tie.

FIG. 2 is a cross-sectional view of the railroad track of FIG. 1 and a side elevational view of the railroad tie and the pair of mud dispersement devices disposed beneath the railroad tie.

FIG. 3 is bottom plan view of the left one of the pair of mud dispersement devices of FIG. 2 as seen along line 3—3 in FIG. 2.

FIG. 4 is a longitudinal sectional view of the mud dispersement device taken along line 4—4 in FIG. 3.

FIG. 5 is a top plan view of the left one of the pair of mud dispersement devices of FIG. 2 as seen along line 5—5 in FIG. 2.

FIG. 6 is an enlarged detailed view of the portion of the mud dispersement device encircled at 6 in FIG. 4.

FIG. 7 is an enlarged detailed view of the portion of the mud dispersement device encircled at 7 in FIG. 4.

FIG. 8 is an enlarged detailed perspective view of a ballast collection and mud dispersion element of the mud dispersement device encircled at 8 in FIG. 3.

FIG. 9 is a bottom plan view showing an alternative embodiment of the mud dispersement device of the present invention.

FIG. 10 is a top plan view showing an alternative embodiment of the mud dispersement device of the present invention.

FIG. 11 is an enlarged detailed perspective view of an alternative embodiment of the ballast collection and mud dispersion element of the mud dispersement device encircled at 11 in FIG. 9.

FIG. 12 is an enlarged detailed perspective view showing an alternative embodiment of a support element of the mud dispersement device encircled at 12 in FIG. 10.

DETAILED DESCRIPTION OF THE INVENTION

Referring to the drawings, and particularly to FIGS. 1 and 2, there is illustrated a railroad track having a pair of railroad rails R supported upon a plurality of railroad ties T that are supported by a quantity of ballast material B applied on the roadbed of the track. As illustrated, a pair of mud dispersement devices of the present invention, generally designated 10, are disposed beneath each of the railroad ties T (only one pair of the devices 10 below one tie T being shown in FIGS. 1 and 2) between a lower surface S of the tie T and the ballast material B of the roadbed. Also as illustrated, the mud dispersement devices 10 underlie respective opposite halves of the tie T, extending from outer ends 10A of the devices 10 disposed adjacent to respective opposite ends of the tie T inwardly to inner ends 10B of the devices 10 that are disposed near but spaced from one another in opposite directions from a middle portion M of the tie T. The devices 10 are arranged as mirror images of one another with reference to a central longitudinal vertical plane extending between and parallel to the rails R of the railroad track.

Referring now to FIGS. 3–8, each mud dispersement device 10 of the present invention basically includes a generally flat elongated structure 12 which underlies one of the respective opposite halves of the tie T and rests upon the ballast material B supporting the tie, a plurality of upper support elements 14 on the top of the elongated structure 12, and a plurality of lower ballast collection and mud dispersion elements 16 on the bottom of the elongated structure 12.

The flat elongated structure 12 of each device 10 is constructed of a pair of elongated side members 18 and an elongated inclined plate 20. Each of the side members 18 of the elongated structure 12 has opposite outer and inner ends 18A, 18B and opposite top and bottom longitudinal edges 18C, 18D. The side members 18 are identical to one another and are rectangular in shape, with each side member 18 having a height dimension being substantially less than the length dimension thereof.

The elongated inclined plate 20 of the elongated structure 12 has opposite upper and lower ends 20A, 20B and opposite top and bottom surfaces 20C, 20D. The plate 20 is disposed between and along the side members 18 and rigidly connected thereto. The plate 20 is rectangular in shape and has a width dimension extending between the side members 18 being substantially less than a length dimension extending parallel to the longitudinal edges 18C, 18D of the side members 18.

Furthermore, the elongated inclined plate 20 extends in diagonal fashion along the side members 18 between the outer and inner ends 18A, 18B of each of the side members 18. More particularly, the plate 20 extends from its lower end 20B being located adjacent to the bottom longitudinal edges 18D of the side members 18 at the inner ends 18B thereof diagonally outwardly along the side members 18 to the upper end 20A of the plate 20 being located adjacent to the upper longitudinal edges 18C of the side members 18 at the outer ends 18B thereof so as to define a generally wedge-shaped cavity 22 below the bottom surface 20D of the inclined plate 20 which increases in height proceeding from the inner ends 18B of the side members 18 to the outer ends 18A thereof. The inclined plate 20 defines the top of the wedge-shaped cavity 22 while the side members 18 define the opposite longitudinal sides thereof. Thus, except for its bottom and outer end, the wedge-shaped cavity 22 is enclosed by the plate 20 and side members 18.

As mentioned above, the mud dispersement devices 10 are arranged beneath the railroad tie T as mirror images of one another relative to a longitudinal central vertical plane extending parallel to the rails R. Therefore, the wedge-shaped cavities 22 of the respective devices 10 are likewise arranged as mirror images of one another, that is, the cavities 22 increase in height proceeding in opposite directions from the middle portion M of the railroad tie T. It will be understood that inclined orientation of the plate 20 between the side members 18 also defines an upper wedge-shaped chamber 23 above the top surface 20C of the inclined plate 20 which is the reverse of the lower wedge-shaped cavity 22.

The elongated structure 12 also includes an end member 24 extending transversely between and connected to the inner ends 18B of the side members 18. The end member 24 has opposite upper and lower longitudinal edges 24A, 24B, with the inclined plate 20 at its lower end 20B located at and extending from adjacent to the lower longitudinal edge 24B of the end member at the inner ends 18B of the side members 18. The end member 24 is rectangular in shape and has a length dimension extending between the side members 18 being the same as the width dimension of the inclined plate 20 and substantially greater than a height dimension of the end member 24 which is substantially the same as the height dimension of the side members 18.

The upper support elements 14 of each device 10 are preferably a plurality of ribs 14 rigidly mounted on the top surface 20C of the inclined plate 20 and project upwardly therefrom. The function of the ribs 14 is to support and strengthen the plate 20 which is designed to receive loads of up to 65 psi. The upper ribs 14 are disposed to contact the lower surface S of the railroad tie T so as to receive therefrom and transmit downwardly to the inclined plate 20 the load produced and imposed on the tie T by rolling stock moving on the railroad track. Additionally, the upper ribs 14 are spaced from one another along a longitudinal dimension of the elongated structure 12 which is the same as the length dimension of the inclined plate 20. Also, the upper ribs 14 extend between and are connected to the side members 18 so as to strengthen the inclined plate 20. The upper ribs 14 can be progressively spaced farther apart from one another proceeding from the lower end 20B of the plate 20 to the upper end 20A thereof. The upper ribs 14 are preferably elongated straight structures extending generally parallel to one another.

The upper support elements 14 may have other configurations as well. For example, FIGS. 10 and 12 illustrate the upper support elements in the form of a plurality of short hollow tubes 26 rigidly connected to and projecting upwardly from the top surface 20C of the inclined plate 20 for contacting the lower surface S of the railroad tie T and transmitting the downward load from the tie T to the inclined plate 20. As with the ribs 14, the tubes 26 are progressively greater in height (or axial length) proceeding from the upper end 20A of the inclined plate 20 to the lower end thereof. The progressively greater height of each tube 26 allows an upper edge 26A of each tube 26 to contact the lower surface S of the railroad tie T. Some of the tubes 26 are aligned transversely in pairs relative to the length of the plate 20, while other single ones of the tubes 26 are disposed between the adjacent pairs thereof.

Referring to FIGS. 3, 4 and 6–8, the lower ballast collection and mud dispersion elements 16 are rigidly mounted on a bottom surface 22 of the inclined plate 14 and extend downwardly therefrom. The lower elements 16 are preferably blade-shaped projections 16 arranged in a plurality of groups thereof spaced from one another along the length dimension of the inclined plate 20. The projections 16 of each group extend in an arcuate-shaped row arranged transversely to the length dimension of the plate 20 or, in other words, along the width dimension of the plate 20 between the side members 18. Further, the projections 16 in each group are spaced apart from one another. Also, the projections 16 in each group are progressively greater in height proceeding from the lower end 20B of the inclined plate 20 to the upper end 20A thereof. Each of the blade-shaped projections 16 has a surface 16A facing towards the lower end 20B of the inclined plate 20 that is inclined at an angle to the bottom surface 20D of the plate 20 which falls within the range of about 75 to 80 degrees and preferably is about 78 degrees. The projections 16 also have an opposite surface 16B facing towards the upper end 20A of the inclined plate 20 that is substantially perpendicular to the bottom surface 20D of the plate 20.

The blade-shaped projections 16 extend downwardly through the wedge-shaped cavity 22 and into the ballast material B for maintaining the ballast material B in a load bearing area beneath the railroad tie T while permitting the passage of mud and the like from the load bearing area through the wedge-shaped cavity 22 toward and beyond the outer end 10A of the device 10. The mud and the like is forced outwardly as a result of the mud being squeezed by alternating vertical contraction and expansion of the wedge-shaped cavity 22 toward and away from the ballast material B in response to alternating application and release of the downward load to and from the inclined plate 20 by the railroad tie T as produced by the movement of the rolling stock over the railroad tie T.

The lower ballast collection and mud dispersion elements 16 may have other configurations as well. For example, FIGS. 9 and 11 illustrate the lower elements in the form of a plurality of chevrons or V-shaped projections 28 rigidly connected to and projecting downwardly from the bottom surface 20D of the inclined plate 20. The V-shaped projections 28 extend downward into the ballast material B to maintain and consolidate the ballast material B in the load bearing area beneath the railroad tie T. The V-shaped projections 28 are arranged to define a plurality of groups thereof spaced from one another along the length of the inclined plate 20 and are progressively greater in height proceeding from the lower end 20B to the upper end 20A of the inclined plate 20. The V-shaped projections 28 of each group are arranged in a straight line across the width of the inclined plate 20 and are spaced from each other the same as the blade-shaped projections 16 to allow moisture and mud to flow along the bottom surface 20D of the inclined plate 20 towards the outer end 10A of the mud dispersement plate 10 when the aforementioned load is applied to the railroad tie T.

As mentioned above, the mud dispersement devices 10 are preferably identical to one another and are of respective sizes relative to the railroad tie T so that a pair of the devices 10 may be disposed beneath a given railroad tie T with each device being beneath opposite halves of the tie T and oriented so that outer ends 10A of the devices 10 are located adjacent to respective opposite ends of the tie T and inner ends 10B of the devices are spaced apart from one another near but in opposite directions from the middle portion M of the railroad tie T. As one example, each side member 18 of the devices 10 may be 43 inches long, 1¼ inches high and ¼ inch in thickness. Also, the inclined plate 10 may be 8½ inches wide, 43 inches long and ¼ inch in thickness. The mud dispersement device 10 can be fabricated in any suitable known manner, such as by casting from iron material or the like. A device 10 having the above-described construction and dimensions is adapted specifically for use with a 9 foot railroad tie T; however, it will be readily understood that these dimensions may be altered to adapt the mud dispersement plate 10 for use with railroad ties T of different sizes. The ballast material B is typically ½ to 3 inch size rock. The lateral spacing between the lower projections 16 is ½ inch so as to prevent passage of the ballast material between the projections 16. The device 10 may be fastened to the tie T in any suitable manner, such as by use of nails, bolts, or adhesive. Also, it is within the purview of the present invention that the devices 10 may be provided as an integral part of a composite tie.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A mud dispersement device for use beneath a railroad tie of a railroad track and upon ballast material applied on a roadbed supporting the railroad tie, said mud dispersement device comprising:

(a) a generally flat elongated structure for underlying at least a portion of the railroad tie and resting upon ballast material supporting the tie, said elongated structure having opposite inner and outer ends and opposite top and bottom surfaces, said elongated structure defining a wedge-shaped cavity below said bottom surface which increases in height proceeding from said inner end of said elongated structure to said outer end thereof;

(b) upper means mounted on said top surface of said elongated structure for contacting the railroad tie to transmit a load produced by rolling stock moving on the railroad track downwardly from the railroad tie to said elongated structure; and (c) lower means mounted on said bottom surface of said elongated structure and extending downwardly through said wedge-shaped cavity for insertion into the ballast material supporting said elongated structure, said lower means for maintaining the ballast material in a load bearing area beneath the railroad tie while permitting the passage of mud from the load bearing area through said wedge-shaped cavity toward and beyond said outer end of said elongated structure as a result of the mud being squeezed by alternating vertical contraction and expansion of said wedge-shaped cavity toward and away from the ballast material in response to alternating application and release of the downward load to and from the elongated structure.

2. The device of claim 1 wherein said upper means is a plurality of support elements mounted on said top surface of said elongated structure and extending upwardly therefrom for contacting the railroad tie, said support elements being spaced apart from one another along a longitudinal dimension of said elongated structure extending between said outer and inner ends thereof.

3. The device of claim 1 wherein said lower means is a plurality of ballast collection and mud dispersion elements mounted on said bottom surface of said elongated structure and extending downwardly therefrom for insertion into the ballast material, said ballast collection and mud dispersion elements being spaced apart from one another along a longitudinal dimension of said elongated structure extending between said opposite outer and inner ends thereof.

4. The device of claim 3 wherein said ballast collection and mud dispersion elements are arranged in a plurality of groups extending generally transverse to said longitudinal dimension, said ballast collection and mud dispersion elements in each group being spaced apart from one another generally transversely to said longitudinal dimension of said elongated structure.

5. The device of claim 4 wherein said ballast collection and mud dispersion elements in each group are progressively greater in height proceeding along said longitudinal dimension from said inner end of said elongated structure to said outer end thereof.

6. A mud dispersement device for use beneath a railroad tie of a railroad track and upon ballast material applied on a roadbed supporting the railroad tie, said mud dispersement device comprising:

(a) a pair of elongated side members each having opposite inner and outer ends and opposite top and bottom longitudinal edges;

(b) an elongated inclined plate having opposite top and bottom surfaces and opposite upper and lower ends, said inclined plate being disposed between and along said side members and rigidly connected thereto, said inclined plate extending diagonally between said outer and inner ends of each of side members from said lower end of said inclined plate located adjacent to said bottom longitudinal edges of said side members at said inner ends thereof to said upper end of said inclined plate located adjacent to said top longitudinal edges of said side members at said outer ends thereof so as to define a wedge-shaped cavity below said bottom surface of said inclined plate which increases in height proceeding from said inner ends of said side members to said outer ends thereof;

(c) upper means mounted on said top surface of said inclined plate for contacting the railroad tie to transmit a load produced by rolling stock moving on the railroad track downwardly from the railroad tie to said inclined plate; and (d) lower means mounted on said bottom surface of said inclined plate and extending downwardly through said wedge-shaped cavity for insertion into the ballast material supporting said device, said lower means for maintaining the ballast material in a load bearing area beneath the railroad tie while permitting the passage of mud from the load bearing area through said wedge-shaped cavity toward and beyond said outer end of said side members as a result of the mud being squeezed by alternating vertical contraction and expansion of said wedge-shaped cavity toward and away from the ballast material in response to alternating application and release of the downward load to and from said inclined plate.

7. The device of claim 6 wherein said side members are identical to one another and rectangular in shape, each side member having a height dimension being substantially less than a length dimension thereof.

8. The device of claim 7 wherein said inclined plate is rectangular in shape and has a width dimension extending between said side members being substantially less than a length dimension extending parallel to said side members.

9. The device of claim 6 wherein said upper means is a plurality of support elements mounted on said top surface of said inclined plate and extending upwardly therefrom for contacting the railroad tie, said support elements being spaced apart from one another along a longitudinal dimension of said inclined plate extending between said opposite upper and lower ends thereof.

10. The device of claim 9 wherein at least some of said support elements are spaced apart from one another along a transverse dimension of said inclined plate extending between said pair of side members.

11. The device of claim 9 wherein said support members are progressively greater in height proceeding along said longitudinal dimension from said upper end of said inclined plate to said lower end thereof.

12. The device of claim 6 wherein said lower means is a plurality of ballast collection and mud dispersion elements mounted on said bottom surface of said inclined plate and extending downwardly therefrom for insertion into the ballast material, said ballast collection and mud dispersion elements being spaced apart from one another along a longitudinal dimension of said inclined plate extending between said opposite upper and lower ends thereof.

13. The device of claim 12 wherein said ballast collection and mud dispersion elements are arranged in a plurality of groups extending generally transverse to said longitudinal dimension, said ballast collection and mud dispersion elements in each group being spaced apart from one another generally transversely to said longitudinal dimension of said inclined plate.

14. The device of claim 13 wherein said ballast collection and mud dispersion elements in each group are progressively greater in height proceeding along said longitudinal dimension from said lower end of said inclined plate to said upper end thereof.

15. The device of claim 6 wherein said upper means is a plurality of ribs mounted on and projecting upwardly from said top surface of said inclined plate and extending between and connected to said side members, said ribs being spaced from one another along a longitudinal dimension of said inclined plate extending between said opposite upper and lower ends thereof.

16. The device of claim 15 wherein said ribs are elongated straight structures extending generally parallel to one another.

17. The device of claim 15 wherein said ribs are progressively spaced farther apart from one another proceeding from said lower end of said inclined plate to said upper end thereof.

18. The device of claim 6 wherein said upper means is a plurality of tubes mounted on and projecting upwardly from said top surface of said inclined plate, said tubes being spaced from one another along a longitudinal dimension of said inclined plate extending between said opposite upper and lower ends thereof.

19. The device of claim 6 wherein said lower means is a plurality of blade-shaped projections mounted on and projecting downwardly from said bottom surface of said inclined plate, said projections being arranged in a plurality of groups thereof spaced from one another along a longitudinal dimension of said inclined plate extending between said opposite upper and lower ends thereof, said projections of each group extending in an arcuate-shaped row across said inclined plate between said side members.

20. The device of claim 19 wherein each of said blade-shaped projections has a surface facing towards said lower end of said inclined plate that is inclined at an angle to said inclined plate falling within the range of about 75 to 80 degrees.

21. The device of claim 6 wherein said lower means is a plurality of V-shaped projections mounted on and projecting downwardly from said bottom surface of said inclined plate, said V-shaped projections being arranged in a plurality of groups thereof spaced from one another along a longitudinal dimension of said inclined plate extending between said opposite upper and lower ends thereof, said projections of each group extending in a row across said inclined plate between said side members.

22. In combination with a railroad tie of a railroad track, a pair of mud dispersement devices disposed beneath the railroad tie and upon ballast material applied on a roadbed supporting said railroad tie, each of said mud dispersement devices comprising:

(a) a generally flat elongated structure disposed under one of a pair of halves of said railroad tie and resting upon ballast material supporting said tie, said elongated structure having opposite inner and outer ends and opposite top and bottom surfaces, said inner end of said elongated structure being disposed adjacent to a middle portion of said tie and said outer end of said elongated structure being disposed adjacent to one of a pair of opposite ends of said tie, said elongated structure defining a wedge-shaped cavity below said bottom surface which increases in height proceeding from said inner end of said elongated structure to said outer end thereof;

(b) upper means mounted on said top surface of said elongated structure for contacting the railroad tie to transmit a load produced by rolling stock moving on the railroad track downwardly from the railroad tie to said elongated structure; and (c) lower means mounted on said bottom surface of said elongated structure and extending downwardly through said wedge-shaped cavity and into the ballast material supporting said elongated structure, said lower means for maintaining the ballast material in a load bearing area beneath the railroad tie while permitting the passage of mud from the load bearing area through said wedge-shaped cavity toward and beyond said outer end of said elongated structure as a result of the mud being squeezed by alternating vertical contraction and expansion of said wedge-shaped cavity toward and away from the ballast material in response to alternating application and release of the downward load by the railroad tie to and from the elongated structure;

(d) each of said mud dispersion devices having a length that is less than one half of a length of said railroad tie such that said pair of said mud dispersement devices are respectively disposed beneath opposite halves of said railroad tie with said inner ends of said mud dispersion devices being spaced apart from one another in opposite directions from said middle portion of said railroad tie and with said wedge-shaped cavities of said mud dispersion devices increasing in height proceeding in opposite directions from said middle portion of said railroad tie.

* * * * *